US011812869B2

(12) United States Patent
Du

(10) Patent No.: US 11,812,869 B2
(45) Date of Patent: Nov. 14, 2023

(54) GARDENING STOOL

(71) Applicant: Ningbo Karmas Far Technology Co., Ltd., Zhejiang (CN)

(72) Inventor: Zhong Du, Zhejiang (CN)

(73) Assignee: Ningbo Karmas Far Technology Co., Ltd., Ningbo (CN)

( * ) Notice: Subject to any disclaimer, the term of this patent is extended or adjusted under 35 U.S.C. 154(b) by 0 days.

(21) Appl. No.: 17/742,422

(22) Filed: May 12, 2022

(65) Prior Publication Data

US 2023/0309698 A1 Oct. 5, 2023

(30) Foreign Application Priority Data

Apr. 2, 2022 (CN) ..... 202210340713.7
Apr. 2, 2022 (CN) ..... 202220880343.1

(51) Int. Cl.

| | |
|---|---|
| ***A47C 4/10*** | (2006.01) |
| ***A47C 4/20*** | (2006.01) |
| ***A47C 4/44*** | (2006.01) |
| ***A47C 9/10*** | (2006.01) |
| *A47C 12/00* | (2006.01) |

(52) U.S. Cl.
CPC ..... *A47C 4/44* (2013.01); *A47C 4/10* (2013.01); *A47C 4/20* (2013.01); *A47C 9/10* (2013.01); *A47C 12/00* (2013.01)

(58) Field of Classification Search
CPC .... A47C 4/10; A47C 4/20; A47C 4/44; A47C 9/027; A47C 9/10; A47C 16/02; A47C 16/04; A47C 12/00; A47C 11/00; A47B 3/002; A47B 3/08
USPC ..... 297/16.1, 16.2
See application file for complete search history.

(56) References Cited

U.S. PATENT DOCUMENTS

| | | | | |
|---|---|---|---|---|
| 2,829,705 | A * | 4/1958 | Godshalk | A47L 13/62 182/20 |
| 4,462,636 | A * | 7/1984 | Markson | A47C 16/02 108/131 |
| 10,098,449 | B2 * | 10/2018 | Chen | A47B 3/08 |
| 11,375,818 | B1 * | 7/2022 | Hu | A47C 7/0213 |
| 11,470,929 | B1 * | 10/2022 | Jenkins | A61H 3/0288 |
| 2004/0201268 | A1 * | 10/2004 | Liao | A47C 11/00 297/423.11 |
| 2005/0225127 | A1 * | 10/2005 | Hsieh | A47C 9/10 297/16.1 |
| 2010/0071600 | A1 * | 3/2010 | Lin | A47B 7/02 108/115 |
| 2019/0001481 | A1 * | 1/2019 | Faibish | A47B 3/08 |

* cited by examiner

*Primary Examiner* — Robert Canfield

(57) ABSTRACT

The disclosure provides a gardening stool, including a seat board, mounting shafts are horizontally fixed at two ends of the seat board, the mounting shafts is rotationally hinged with a support leg, and a clutch mechanism is provided between the mounting shaft and the support leg; the clutch mechanism includes a first connecting piece, a second connecting piece and a third connecting piece, being arranged coaxially; the first connecting piece provided with a first connecting part, is fixed on the mounting shaft; the second connecting piece provided with a second connecting part, is fixed on the support leg; the third connecting piece provided with a third connecting part, is in slide fit on the mounting shaft. The gardening stool of the disclosure can be conveniently folded high in strength, and can be widely used.

10 Claims, 18 Drawing Sheets

GARDENING STOOL

CROSS REFERENCE TO RELATED APPLICATIONS

The present application claims the benefit of Chinese Patent Application Nos. 202210340713.7 filed on Apr. 2, 2022 and 202220880343.1 filed on Apr. 4, 2022. All the above are hereby incorporated by reference in their entirety.

TECHNICAL FIELD

The disclosure relates to a folding stool, and particularly relates to a gardening stool which can be folded and unfolded quickly.

BACKGROUND

The gardening stool is a stool capable of relieving fatigue of garden workers, which can be used for sitting or kneeling during working. A traditional gardening stool is inconvenient to fold, pressing type folding assemblies are used, a plurality of plastic assemblies and one button are provided, push locking is realized through springs, the structure is complex, the cost is high, the contact area is small, and stress concentration and deformation or damage are easily caused. When the traditional gardening stool is used outdoors, mud or other impurities are easy to enter the pressing assemblies, which affects the normal operation of the assemblies and corrodes the springs at the same time, thereby affecting the service life.

SUMMARY

(1) Technical Problem to be Solved

The technical problem to be solved by the disclosure is to provide a gardening stool which is compact in structure, convenient to use, good in locking effect, and convenient to fold.

(2) Technical Solutions for Solving the Problem

The disclosure provides a gardening stool, including a seat board 2, where horizontally arranged mounting shafts 3 are fixed at two ends of the seat board 2, each of the mounting shafts 3 is rotationally hinged with a support leg 1, and a clutch mechanism is provided between the mounting shaft 3 and the support leg 1; the clutch mechanism includes a first connecting piece 51, a second connecting piece 52 and a third connecting piece 4 which are arranged coaxially; the first connecting piece 51 is fixed on the mounting shaft 3, and the first connecting piece 51 is provided with a first connecting part; the second connecting piece 52 is fixed on the support leg 1, and the second connecting piece 52 is provided with a second connecting part; the third connecting piece is in slide fit on the mounting shaft 3, and the third connecting piece is provided with a third connecting part; and when the support leg 3 is rotated to a support state, the first connecting part is coaxial with the second connecting part, the third connecting piece slides outward, and the third connecting part can be connected to the first connecting part and the second connecting part at the same time so as to realize the fixing of the support leg.

Further, the first connecting piece and the second connecting piece are non-circular cylindrical bodies with the same cross section, and the third connecting piece is provided with a sleeve hole having the same shape as the cylindrical body.

Further, the first connecting part and the second connecting part are grooves with the same width, and the third connecting part is a protrusion with the same width as the groove.

Further, the first connecting part and the second connecting part are protrusions with the same width, and the third connecting part is a groove with the same width as the protrusion.

Further, the first connecting piece and the second connecting piece have the same structure, including a connecting piece body, and first grooves or first protrusions are uniformly distributed on side walls of the connecting piece body in a circumferential direction; and an end of the third connecting piece is provided with a sleeve hole, an open end of the sleeve hole faces the first connecting piece and the second connecting piece, and second protrusions which can be inserted into the first grooves or second grooves in which the first protrusions can be clamped are uniformly distributed on an inner wall of the sleeve hole in a circumferential direction.

Further, a chamfer is provided at an end of the first connecting part and/or an end of the third connecting part.

Further, the third connecting piece includes a sleeve body, two ends of the sleeve body are provided with a guide hole 40 and a sleeve hole 41 which are coaxial and are communicated with each other, and a depth of the sleeve hole is greater than or equal to a sum of the thicknesses of the first connecting piece and the second connecting piece.

Further, the support leg 1 includes a support leg body, two hinged seats 11 are provided at upper ends of the support leg body, the two hinged seats 11 are arranged in parallel, each of the hinged seats 11 is provided with a hinged hole for allowing a mounting seat to pass through, and the second connecting piece is fixed on an inner wall of the hinged seat 11 and is coaxial with the hinged hole.

Further, the depth of the guide hole is greater than or equal to ½ of the height of the sleeve body.

Further, the thickness of the first connecting piece or the second connecting piece is greater than or equal to 2 mm and less than or equal to 8 mm.

Further, the distance between the first connecting piece and the second connecting piece is less than or equal to 2 mm.

Further, the clutch mechanisms on the two support legs are located on the same side.

Further, a provided is formed between the first groove and the second protrusion or between the first protrusion and the second groove, and the gap is greater than or equal to 0.3 mm and less than or equal to 1 mm.

Further, the difference between a diameter of the guide hole and a diameter of the mounting shaft is greater than or equal to 0.3 mm and less than or equal to 1 mm.

(3) Beneficial Effects

In the gardening stool of the disclosure, the clutch mechanism is redesigned and optimized and is compact in structure, low in manufacturing cost, and stable and reliable in connection; the clutch mechanism includes few components and is convenient and quick in assembly, and the working stability and reliability are improved; a plurality of connecting parts are uniformly distributed in a circumferential direction, the contact area is large, the contact force is balanced, the phenomenon of stress concentration is avoided, the connection strength is high, and quick positioning and axial insertion of the third connecting piece are facilitated to realize quick connection; the clutch mechanism is completely made of metal and thus is high in strength, good in deformation resistance, resistant to corrosion, good in stability, and long in service life; the clutch mechanisms on the two support legs are located on the same side, so that quick unlocking can be realized, and quick folding is facilitated; and by arranging the limiting devices, the support legs can be quickly unfolded, and two connecting pieces can be quickly positioned, thereby improving the unfolding efficiency and accuracy. The gardening stool of the disclosure can be folded or unfolded quickly and is high in strength, long in service life and wide in application scope.

DETAILED DESCRIPTION

The examples of the disclosure will be described in detail below with reference to the accompanying drawings.

Referring to FIG. 1 to FIG. 11, the disclosure provides a gardening stool, specifically, a gardening stool which can be folded quickly. The gardening stool includes a seat board 2 and support legs 1 hinged at two ends of the seat board.

Figure 1:
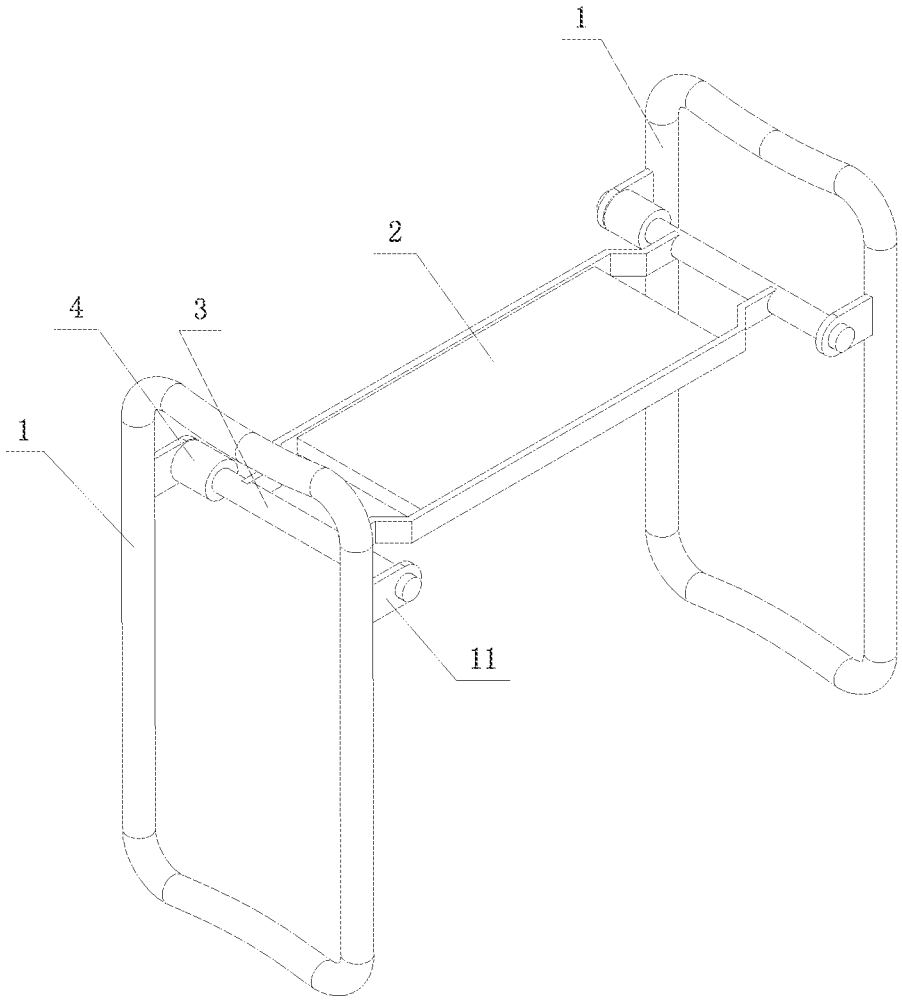
FIG. 1 is a schematic structural view of a gardening stool of the disclosure.
Figure 2:
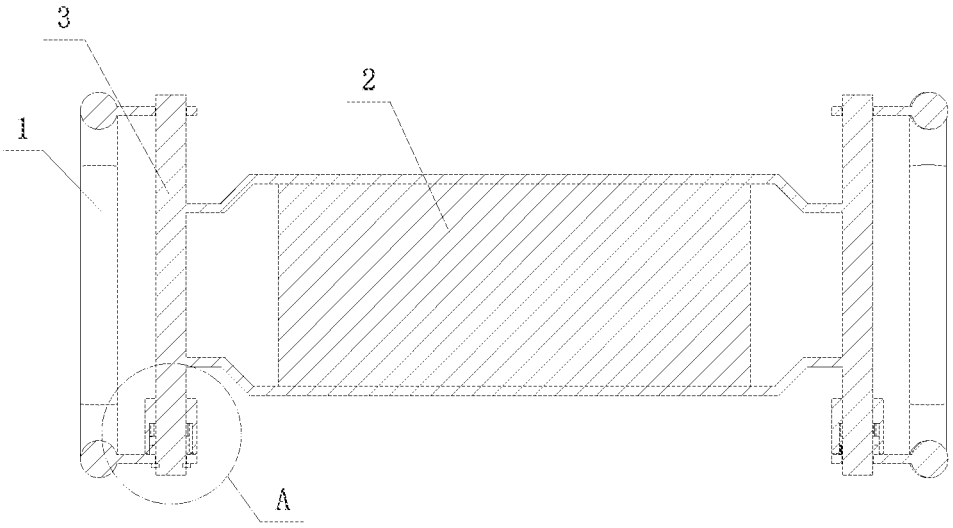
FIG. 2 is a state schematic view of a clutch mechanism when the gardening stool of the disclosure is locked.
Figure 3:
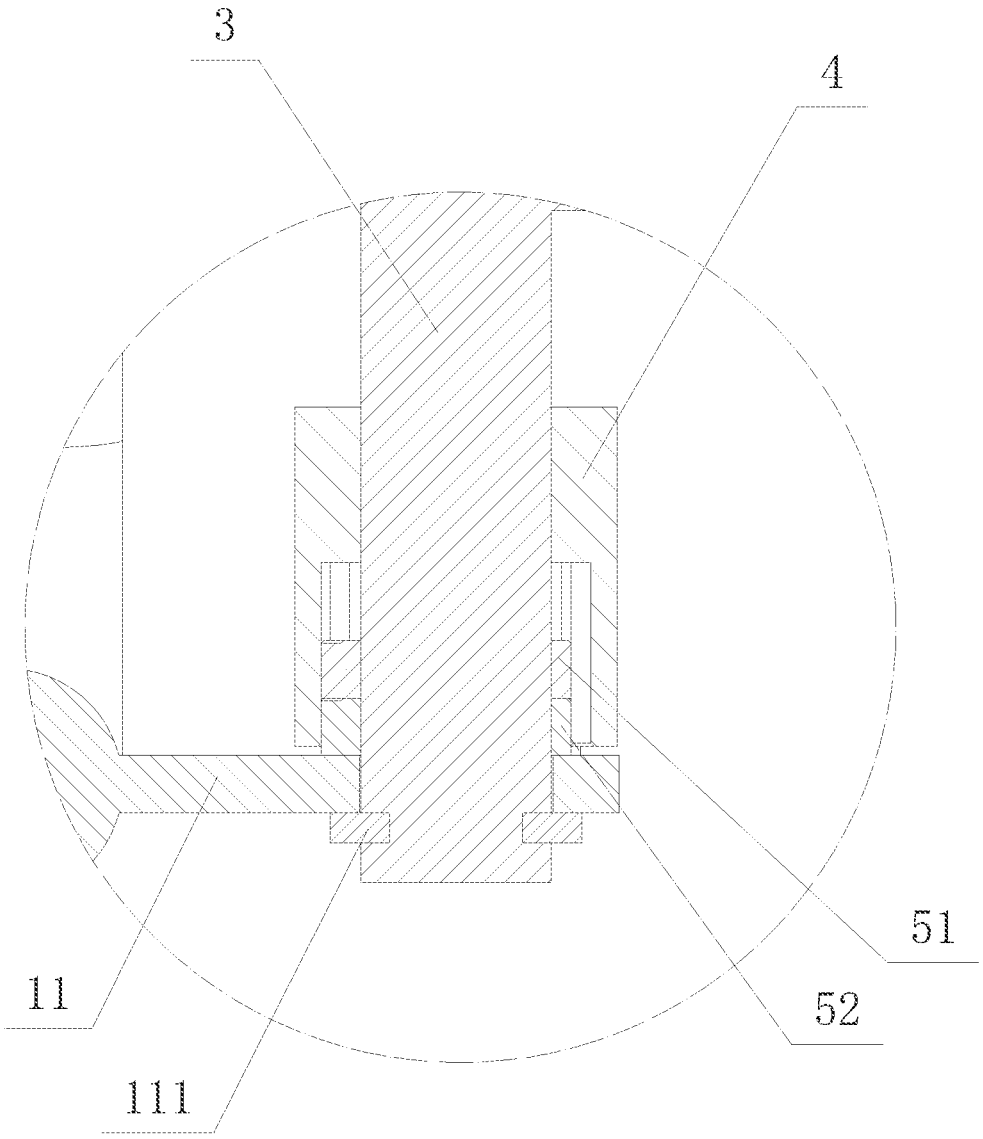
FIG. 3 is an enlarged view of a part A in FIG. 2.
Figure 4:
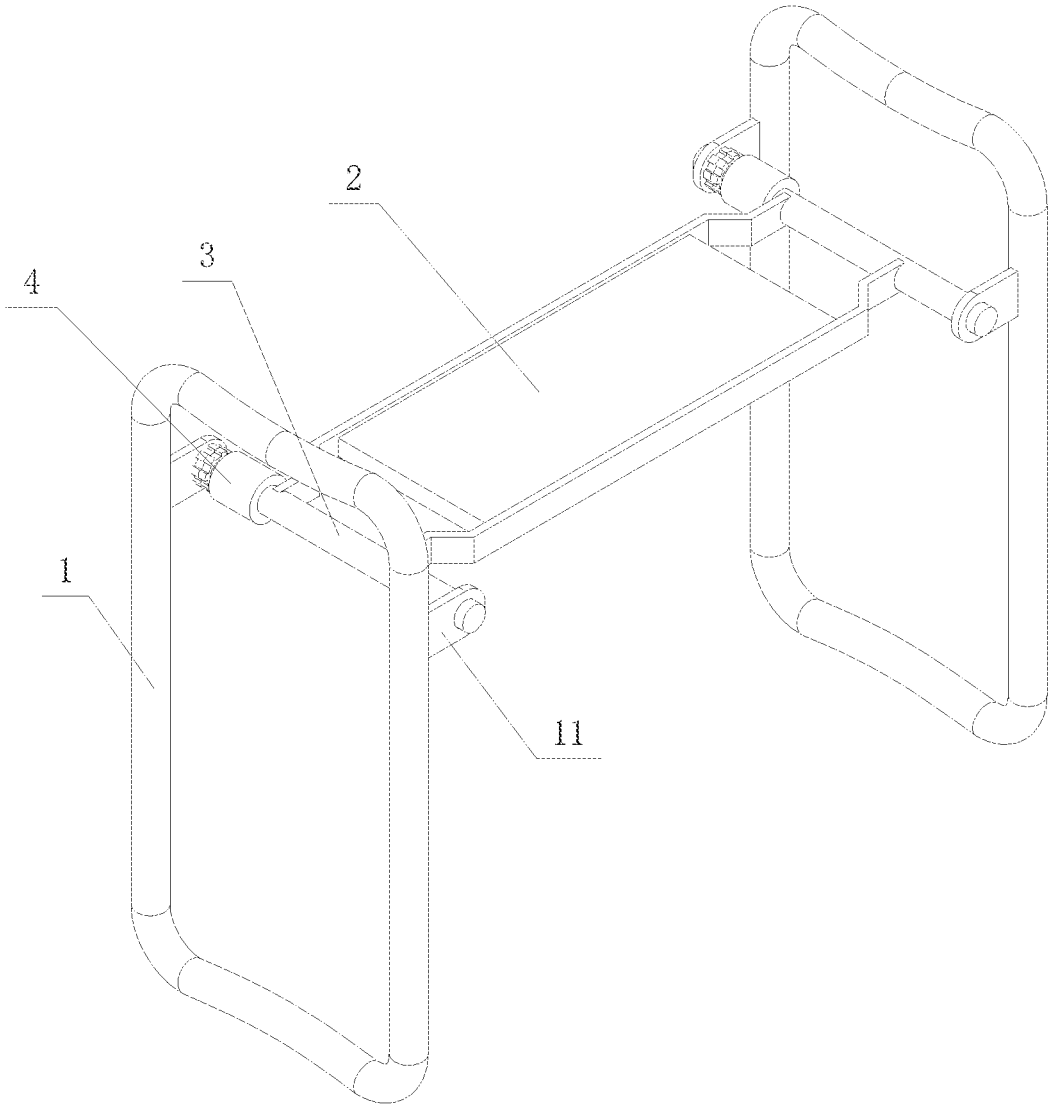
FIG. 4 is a schematic structural view when the gardening stool of the disclosure is unlocked.
Figure 5:
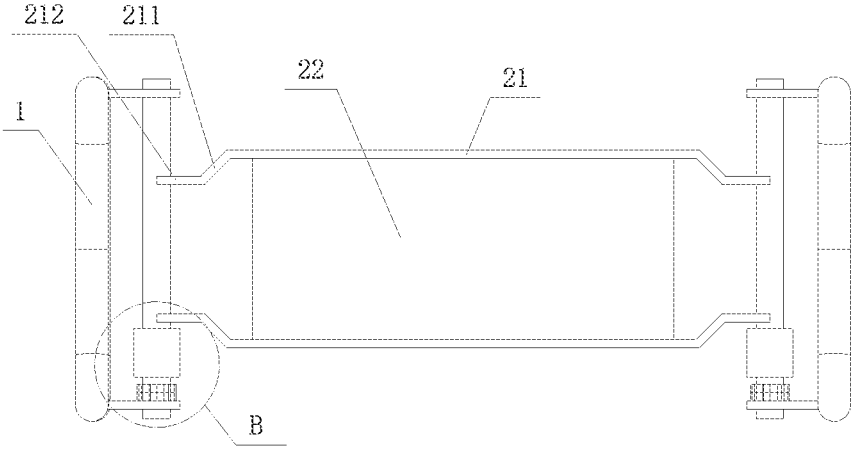
FIG. 5 is a state schematic view of the clutch mechanism when the gardening stool of the disclosure is unlocked.
Figure 6:
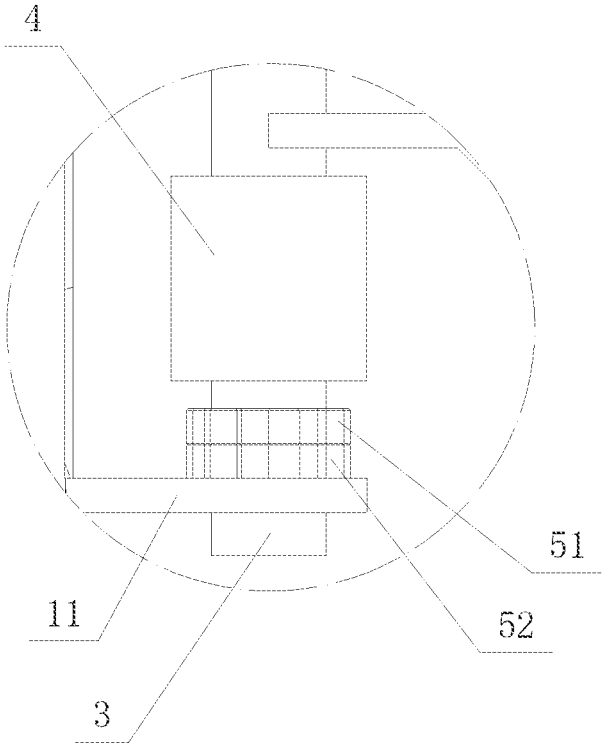
FIG. 6 is an enlarged view of a part B in FIG. 5.
Figure 7:
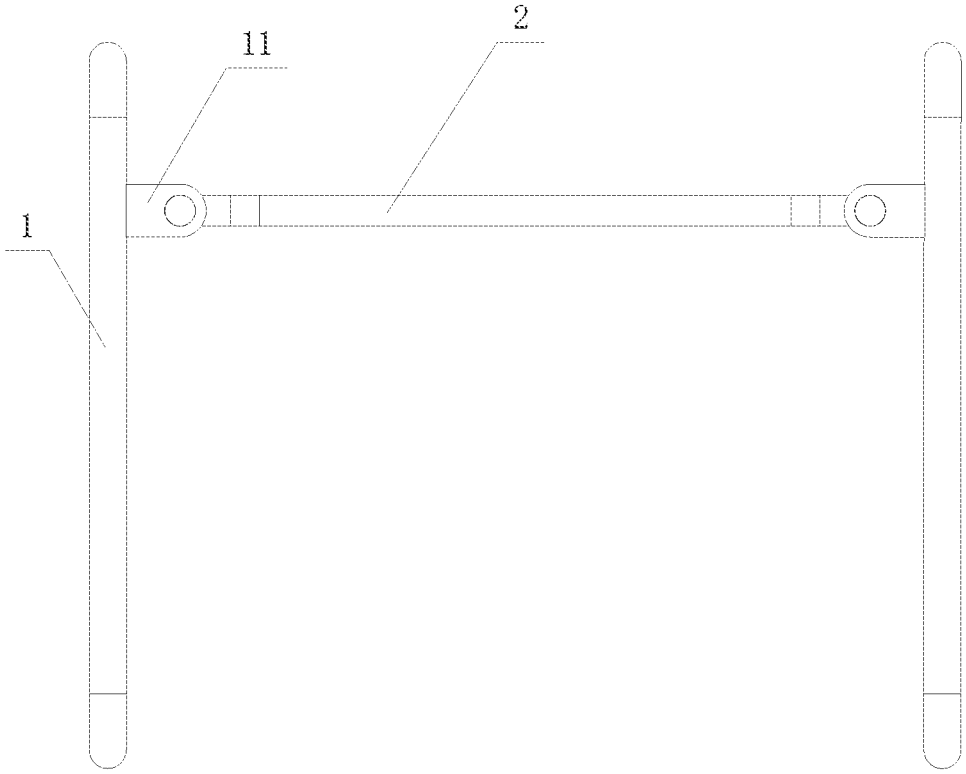
FIG. 7 is a state schematic view when the gardening stool of the disclosure is unfolded.

Each of the support legs 1 includes a support leg body formed by bending a steel pipe, and the support leg body is of a rectangular frame structure as a whole. Referring to FIG. 1 and FIG. 4, hinged seats 11 facing the seat board 2 are provided on two sides of the support leg 1. In this example, the hinged seat 11 is a steel plate, an end of the steel plate is circular to prevent the human body from being scratched during use, the hinged seat is provided with a hinged hole, and two hinged holes are coaxial. The hinged seat is arranged in a position close to the upper end of the support leg, that is, the distance between the hinged seat and the upper end of the support leg is less than the distance between the hinged seat and the lower end of the support leg, and the preferred ratio of the distance between the two is 1:4. During use, the gardening stool can be placed upward or downward; when the gardening stool is placed upward, the seat board is higher and is used for sitting or stepping; and when the gardening stool is placed downward, the seat board is lower and is used for kneeling to prevent a worker from kneeling directly on the ground.

The seat board 2 includes a seat board body 22, and seat board steel frames 21 are symmetrically fixed at front and rear ends of the seat board body 22. In this example, the steel frames are made of steel bars, the steel bars at the front and rear ends are arranged in parallel, and the ends of the steel bars are bent toward each other (that is, the steel bars at the front end are bent rearward, and the steel bars at the rear end are bent forward) to form first connecting rods 211, the ends of the first connecting rods 211 are reversely bent to form second connecting rods 212, the second connecting rods are parallel to each other, mounting shafts 3 are fixed at the ends of the second connecting rods, the mounting shafts are horizontally arranged at the front and rear, that is, the axes of the mounting shafts are parallel to the width direction of the seat board, and the mounting shafts are sleeved in the hinged holes of the hinged seats to realize hinged connection, namely rotational connection. In order to realize axial fixing, snap rings 111 are arranged at the ends of the mounting shafts 3. The seat board body is fixed on the steel frames and is made of plastic or other materials, so that the overall weight can be reduced.

Clutch mechanisms are provided between the mounting shafts 3 and the hinged seats of the support legs 1, and the clutch mechanisms can realize the connection or separation of the seat board 2 and the support legs 1. When the seat board and the support legs are connected, the seat board and the support legs are fixed, so that at this time, the gardening stool can be used normally as a stool. When the seat board and the support legs are separated, the support legs can be rotated, so that at this time, the gardening stool can be folded.

In this example, a mounting region is formed between the second connecting rod 212 and the hinged seat 11, and the clutch mechanism is arranged in the mounting region.

The clutch mechanism includes a first connecting piece 51, a second connecting piece 52 and a third connecting piece 4. Specifically, the first connecting piece 51, the second connecting piece 52 and the third connecting piece 4 are coaxial with the mounting shaft 3; the first connecting piece 51 is fixed on the mounting shaft 3, the first connecting piece is provided with a first connecting part, and the first connecting part is arranged on side walls of the first connecting piece 51 instead of an end (the end is an end surface perpendicular to the axis of the first connecting piece); the second connecting piece 52 is fixed on the support leg 1 and specifically is fixed on an inner side of the hinged seat 11 and faces the first connecting piece 51, the end surfaces of the second connecting piece and the first connecting piece are parallel to each other, the second connecting piece is provided with a second connecting part, and the second connecting part is arranged on side walls of the second connecting piece; and the third connecting piece is in slide fit on the mounting shaft 3, the sliding direction of the third connecting piece is parallel to the axis of the mounting shaft, the first connecting piece 51 is located between the second connecting piece 52 and the third connecting piece 4, and the third connecting piece is provided with a third connecting part.

When the support leg 3 is rotated to a support state, in this example, in the support state, the surface where the support leg is located is perpendicular to the seat board, at this time, the first connecting part on the first connecting piece is coaxial with the second connecting part on the second connecting piece, that is, the first connecting part and the second connecting part (cross sections) are overlapped, the third connecting piece slides outward (toward the first connecting piece or the second connecting piece), the third connecting part can be connected to the first connecting part and the second connecting part at the same time, and then, the second connecting part (support leg) cannot be rotated, thereby realizing the fixing of the support leg. Specifically, the second connecting part is connected to the first connecting part through the third connecting part so as to realize radial fixing between the first connecting piece and the second connecting piece, thereby realizing the locking and fixing of the support leg.

The structures of the first connecting piece 51 (first connecting part), the second connecting piece 52 (second connecting part) and the third connecting piece (third connecting part) can be in various forms, and will be briefly described below.

The first connecting piece and the second connecting piece are cylindrical bodies with the same cross section, and the cross section of the cylindrical body is non-circular. Meanwhile, the third connecting piece is provided with a sleeve hole, and the cross section of the sleeve hole is the same in shape and size as the cross section of the cylindrical body. When the support leg is unfolded to a support state, the cross section of the first connecting piece (first connecting part) is overlapped with the cross section of the second connecting piece (second connecting part). At this time, the sleeve hole can be sleeved into the first connecting piece and the second connecting piece, and the outer walls of the first connecting piece and the second connecting piece are in contact with the inner wall of the third connecting piece to prevent rotation between the two, thereby realizing the locking and fixing of the support leg.

The first connecting piece (or first connecting part) enables the second connecting piece (or second connecting part) to have a diameter difference, so as to realize radial limiting during rotation, and the locking of the support leg depends on the diameter difference.

Figure 13A:
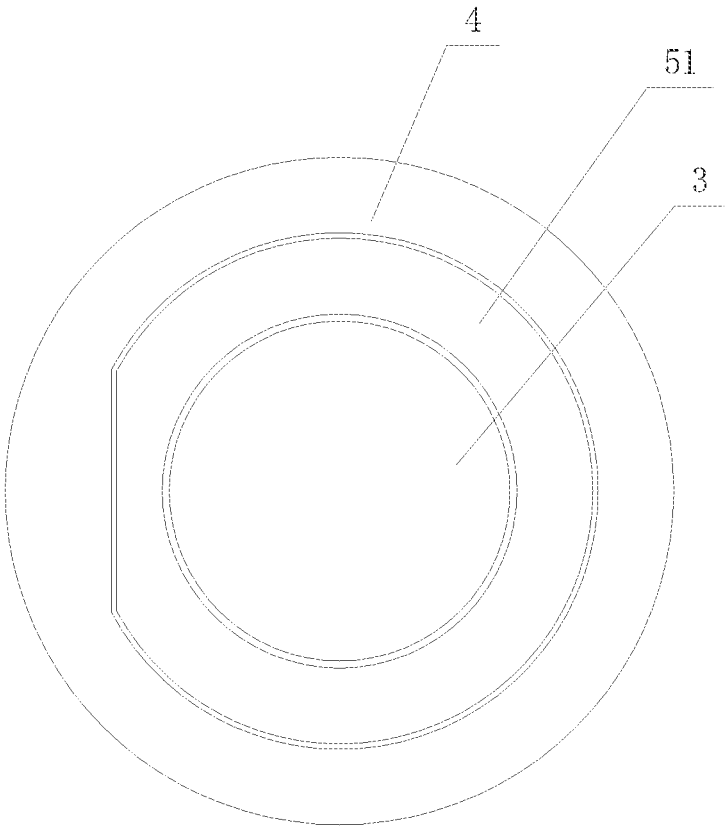
FIG. 13*a* is a schematic structural view of a clutch mechanism of the gardening stool of the disclosure in Example 4.
Figure 13B:
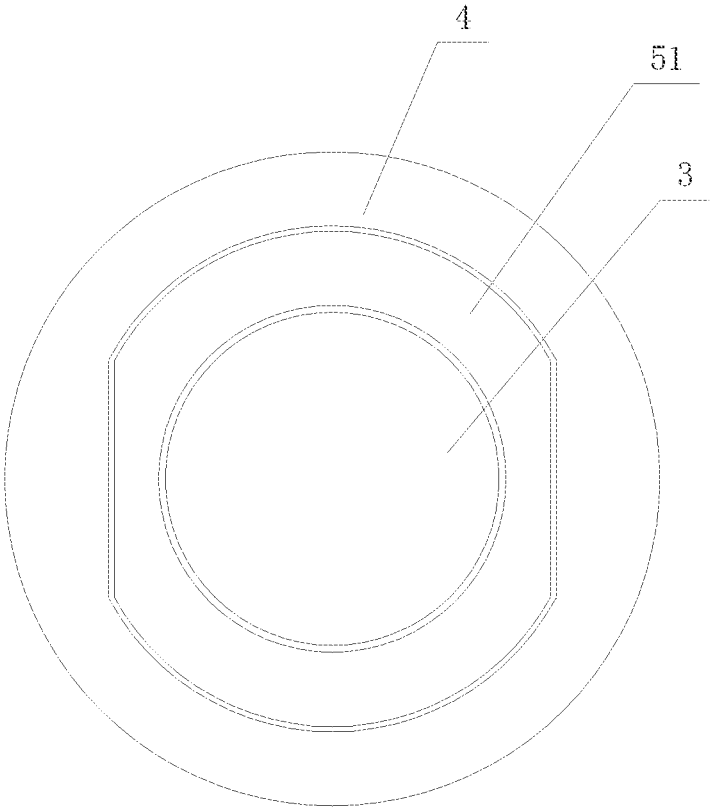
FIG. 13*b* is a schematic structural view of a clutch mechanism of the gardening stool of the disclosure in Example 5.
Figure 13C:
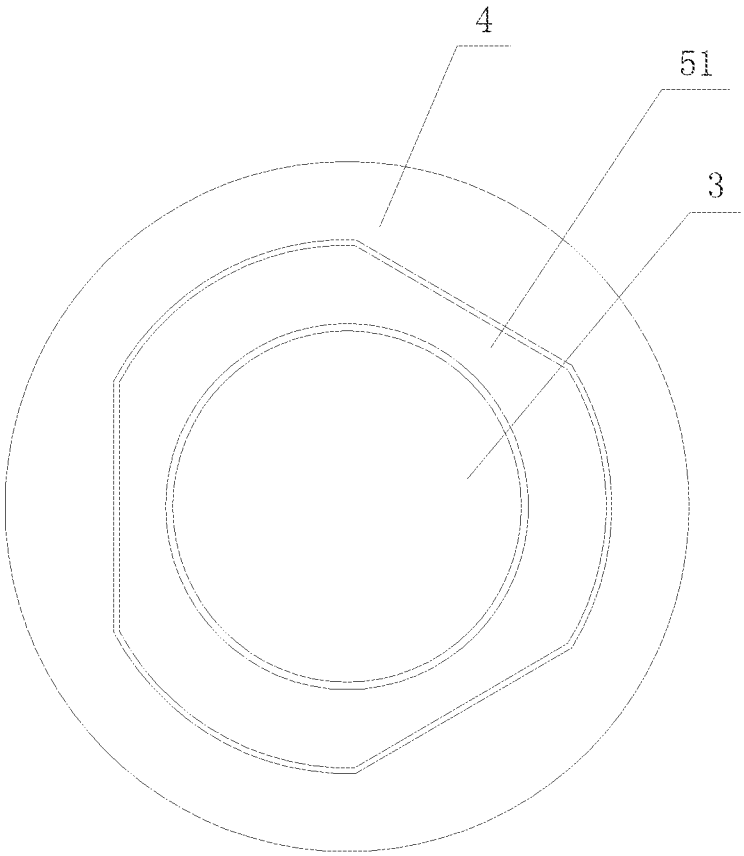
FIG. 13*c* is a schematic structural view of a clutch mechanism of the gardening stool of the disclosure in Example 6.
Figure 13D:
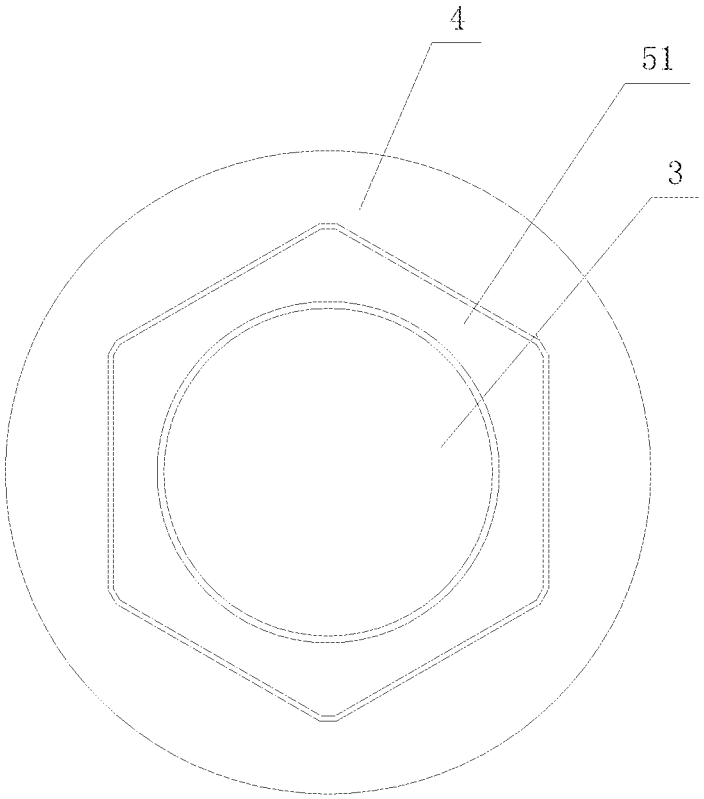
FIG. 13*d* is a schematic structural view of a clutch mechanism of the gardening stool of the disclosure in Example 7.
Figure 14A:
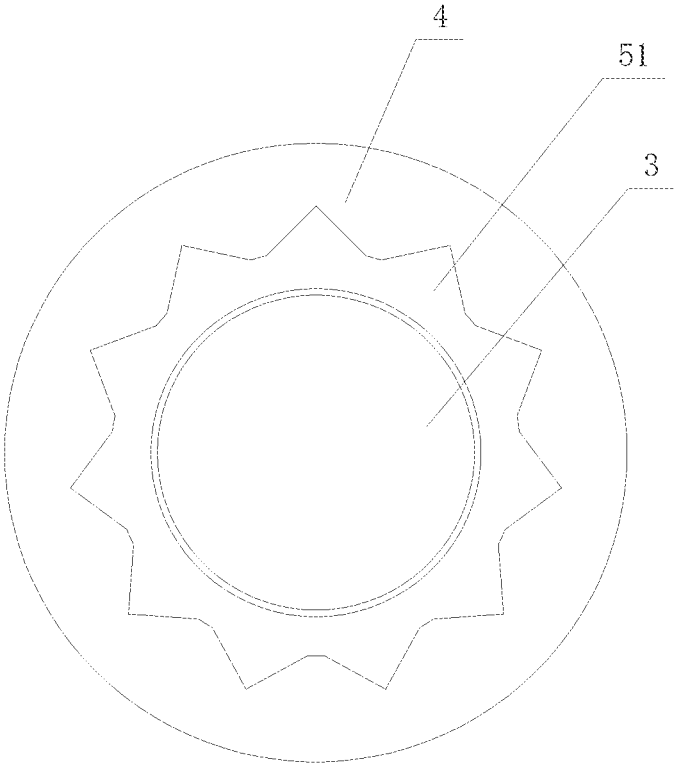
FIG. 14*a* is a schematic structural view of a clutch mechanism of the gardening stool of the disclosure in Example 8.
Figure 14B:
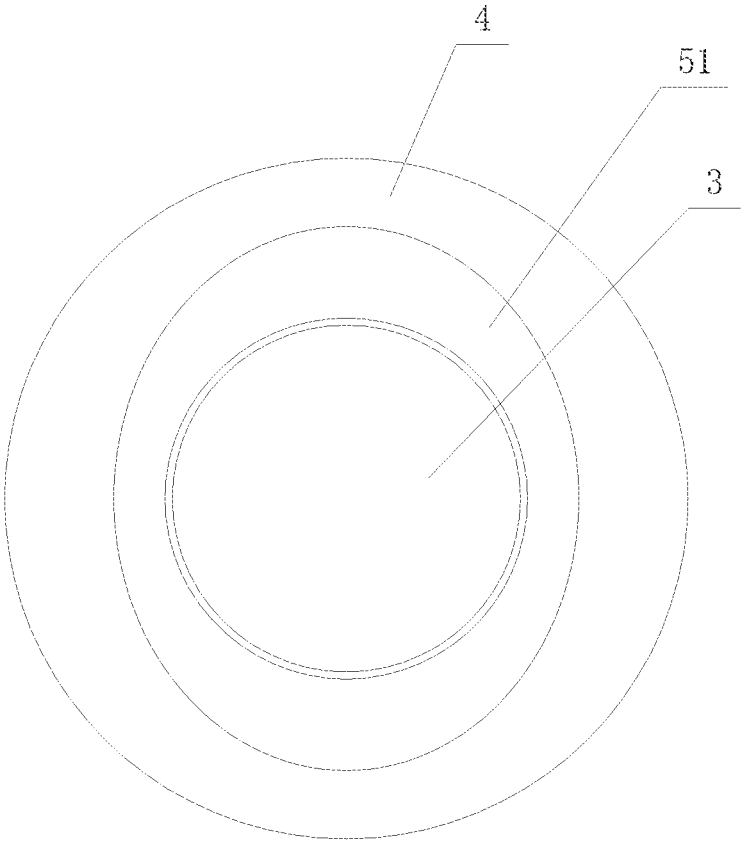
FIG. 14*b* is a schematic structural view of a clutch mechanism of the gardening stool of the disclosure in Example 9.

In this structural form, the cross sections of the first connecting piece and the second connecting piece may be any non-circular shape, such as an oval shape, referring to FIG. 14*b*, or a regular polygon, referring to FIG. 13*d*.

The first connecting part and the second connecting part are grooves (or protrusions) with the same width, and the third connecting part is a protrusion (or groove) with the same width as the groove (or protrusion). The groove (or protrusion) may be rectangular or fan-shaped, referring to FIG. 12*a* to FIG. 12*c*. One or a plurality of grooves (or protrusions) are provided. When a plurality of grooves (or protrusions) are provided, the grooves (or protrusions) are uniformly distributed in a circumferential direction.

Figure 12A:
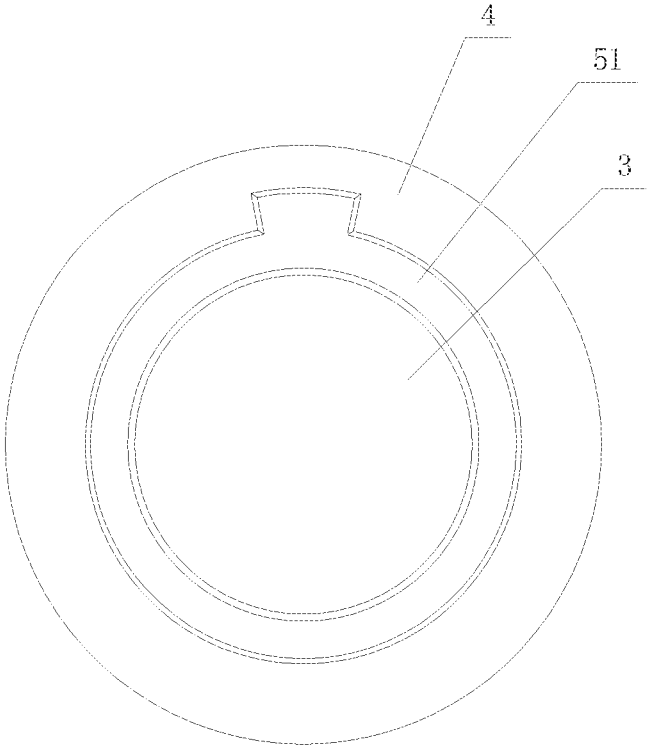
FIG. 12*a* is a schematic structural view of a clutch mechanism of the gardening stool of the disclosure in Example 1.
Figure 12B:
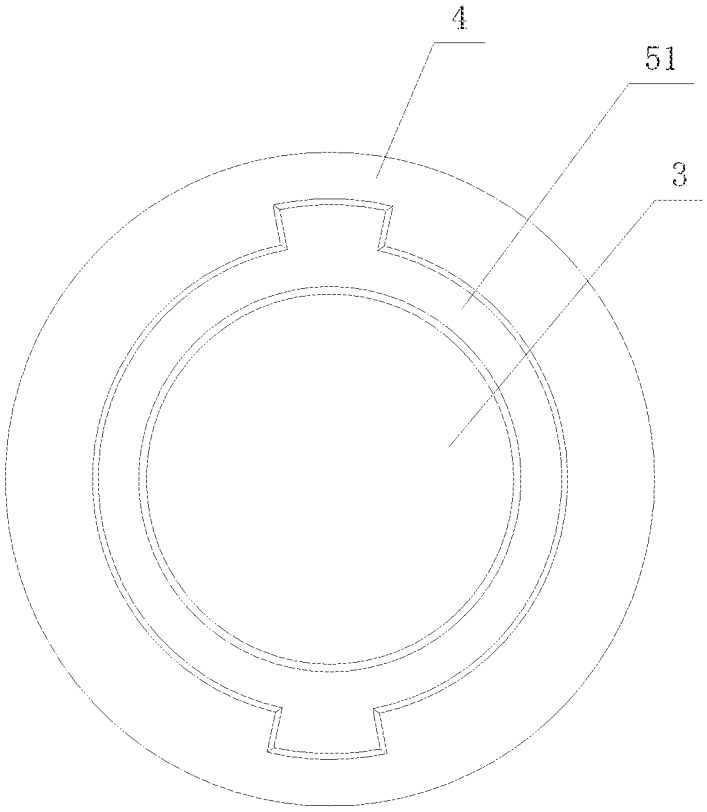
FIG. 12*b* is a schematic structural view of a clutch mechanism of the gardening stool of the disclosure in Example 2.
Figure 12C:
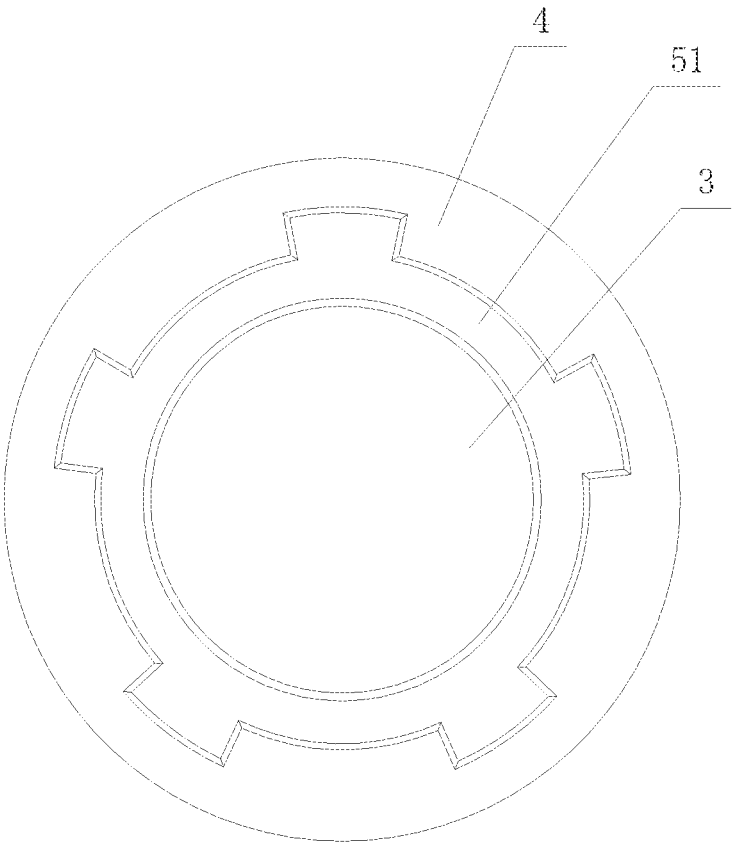
FIG. 12*c* is a schematic structural view of a clutch mechanism of the gardening stool of the disclosure in Example 3.

In FIG. 12*a* to FIG. 12*c*, one protrusion, two protrusions and five protrusions are respectively arranged on the side wall of the first connecting piece or the second connecting piece, and meanwhile, the third connecting piece is provided with the corresponding number of grooves. In the case of reliable structural strength, one groove (or protrusion) can realize the connection between the first connecting piece and the second connecting piece (through the third connecting piece). However, since one groove (or protrusion) can endure a smaller radial torsion, stress concentration is easily caused. Therefore, in order to improve the endured torsion and structural strength, preferably, a plurality of grooves (or protrusions) are provided and uniformly distributed in a circumferential direction to form a structure similar to splines. The stress concentration is avoided, the structural strength and connection reliability are improved, and meanwhile, quick positioning and axial insertion of the third connecting piece in a radial direction can be realized.

The cross section of the groove (or protrusion) may also be triangular. Referring to FIG. 14*a*, a plurality of grooves (or protrusions) are provided and uniformly distributed in a circumferential direction to form a structure similar to saw teeth.

Meanwhile, a plane may be arranged on the side walls of the first connecting piece and the second connecting piece, the plane is parallel to the axis direction of the mounting shaft, and one or a plurality of planes may be provided. Referring to FIG. 13*a* to FIG. 13*d*, one, two, three and six planes are respectively arranged on the side walls of the first connecting piece and the second connecting piece. In the case of reliable structural strength, one plane can realize the connection between the first connecting piece and the second connecting piece (through the third connecting piece). However, since one plane can endure a smaller radial torsion, the diameter difference between plane edges is small, and deformation is easily caused under the action of the torsion. Therefore, in order to improve the endured torsion and improve the structural strength, preferably, a plurality of planes are provided and uniformly distributed in a circumferential direction. When a plurality of planes are provided and uniformly distributed in a circumferential direction, a structure of which the cross section is of a regular polygon is formed, referring to FIG. 13*d*. The stress concentration is avoided, the structural strength and connection reliability are improved, and meanwhile, quick positioning and axial insertion of the third connecting piece in a radial direction can be realized.

Figure 8:
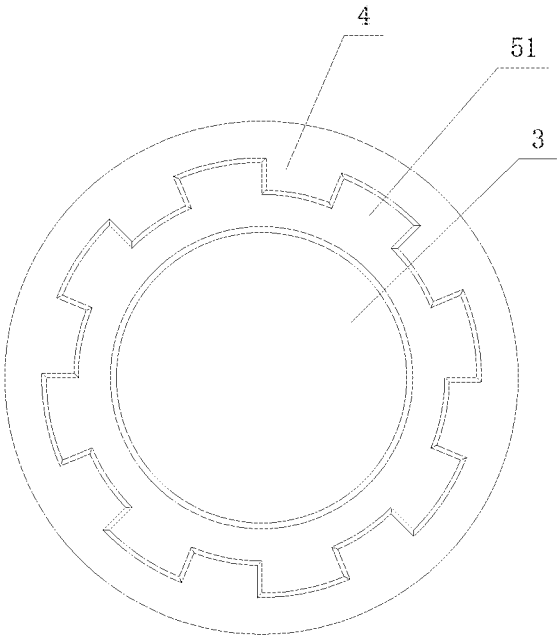
FIG. 8 is a schematic structural view of the clutch mechanism of the gardening stool of the disclosure.
Figure 9:
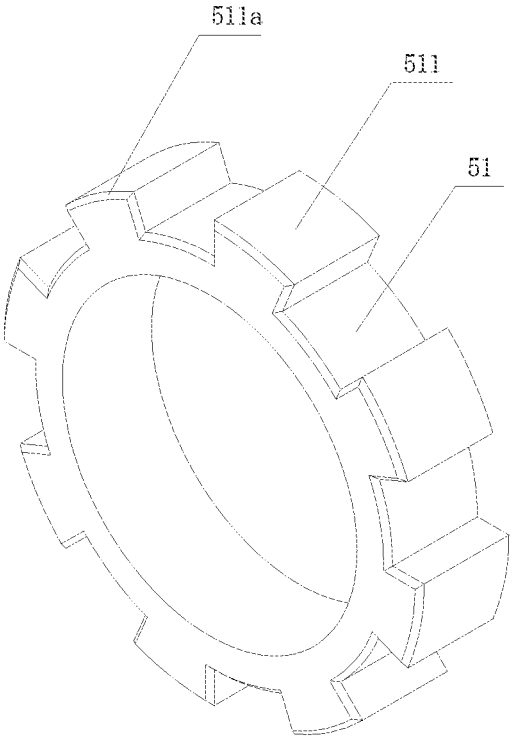
FIG. 9 is a schematic structural view of a first connecting piece of the gardening stool of the disclosure.
Figure 10:
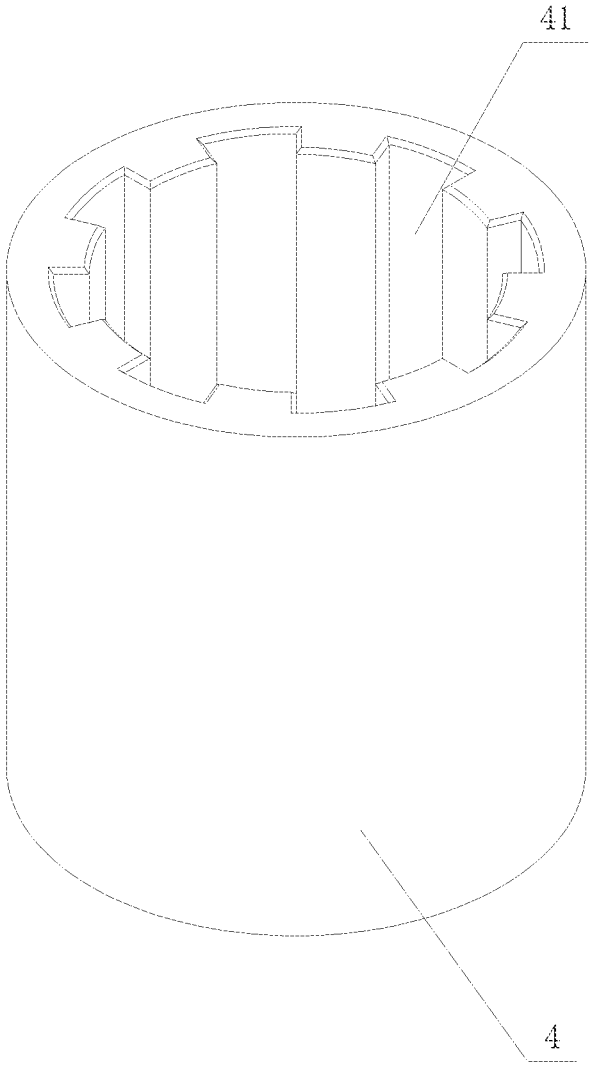
FIG. 10 is a schematic structural view of a third connecting piece of the gardening stool of the disclosure.
Figure 11:
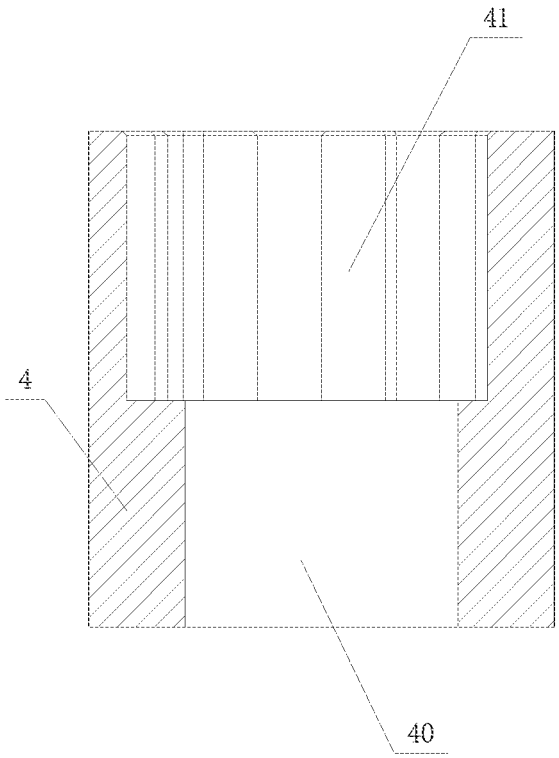
FIG. 11 is a cross-sectional view of the third connecting piece of the gardening stool of the disclosure.

The following takes grooves (or protrusions) as an example for detailed description:

The first connecting piece and the second connecting piece have the same structure, including a connecting piece body, and first grooves or first protrusions 511 are uniformly distributed on side walls of the connecting piece body in a circumferential direction. Referring to FIG. 8 to FIG. 9, preferably, the plane where the side walls of the first grooves or the first protrusions are located passes through the axis of the connecting piece body, that is, the side walls on two sides of the first grooves or the first protrusions are perpendicular to a rotation direction. The third connecting piece includes a sleeve body, two ends of the sleeve body are provided with a guide hole 40 and a sleeve hole 41 which are coaxial and are communicated with each other, and the sleeve body is in slide fit on the mounting shaft through the guide hole. In this example, the difference between the diameter of the guide hole and the diameter of the mounting shaft is greater than or equal to 0.3 mm and less than or equal to 1 mm, which facilitates the sliding operation of the sleeve body. An open end of the sleeve hole faces the first connecting piece and the second connecting piece, and second protrusions which can be inserted into the first grooves or second grooves in which the first protrusions can be clamped are uniformly distributed on an inner wall of the sleeve hole in a circumferential direction. Specifically, the cross section of the entire sleeve hole (including the third connecting part) is the same in shape and size as the cross section of the entire first connecting piece or second connecting piece (including the first connecting part or second connecting part).

When the support leg is rotated to an unfolded state, the first grooves (or first protrusions) on the side walls of the second connecting piece on the hinged seat 11 are aligned (overlapped) with the first grooves (or first protrusions) on the side walls of the second connecting piece on the mounting shaft 3, that is, the first connecting piece is completely overlapped with the second connecting piece. At this time, the second protrusions (or second grooves) on the inner walls of the sleeve hole of the third connecting piece are aligned with the first grooves (or first protrusions) and axially inserted, so as to realize the mutual engagement between the grooves and the protrusions to limit the radial rotation, thereby realizing the locking and fixing of the support leg.

In order to reduce the mounting space and improve the connection strength at the same time, in this example, the thickness of the first connecting piece or the second connecting piece is greater than or equal to 2 mm and less than or equal to 8 mm, the first connecting piece or the second connecting piece is made of metal materials with higher strength, such as stainless steel, and is fixed by welding, and the third connecting piece is also made of metal materials with higher strength. Moreover, the distance between the first connecting piece and the second connecting piece is less than or equal to 2 mm, which can not only reduce the mounting space, but also improve the connection strength. Preferably, an end surface of the first connecting piece is in contact with an end surface of the second connecting piece. The depth of the sleeve hole is greater than or equal to the sum of the thicknesses of the first connecting piece and the second connecting piece, and then, the first connecting piece and the second connecting piece can be completely clamped in the sleeve hole, thereby increasing the contact area and further improving the connection strength and connection reliability. The depth of the guide hole is greater than or equal to ½ of the height of the sleeve body, which can avoid deflection due to a short contact length between the guide hole and the mounting shaft so as to improve the coaxiality, thereby facilitating the realization of quick clutch. In order to facilitate the clamping and avoid the rotation under forces at the same time, in this example, a gap is provided between the first groove and the second protrusion or between the first protrusion and the second groove, and the gap is greater than or equal to 0.3 mm and less than or equal to 1 mm Meanwhile, in order to facilitate the axial insertion of the sleeve, a chamfer 511*a* is provided at an end of the first connecting part or an end of the third connecting part (sleeve hole).

In order to facilitate quick connection or separation, each support leg is provided with a clutch mechanism, and the clutch mechanisms are located on the same side, thereby facilitating the operation. During separation, the gardening stool is swung to the side without the clutch mechanism, and under the action of inertia, the third connecting piece slides and is separated from the second connecting piece and the first connecting piece, thereby realizing quick folding. Correspondingly, during unfolding, the support leg is rotated to an unfolded angle, the gardening stool is swung to the side with the clutch mechanism, and under the action of inertia, the third connecting piece slides to and is sleeved in the first connecting piece and the second connecting piece, thereby realizing quick connection.

In order to realize quick unfolding and positioning of the support leg, that is, in order to quickly align the first connecting piece with the second connecting piece and avoid over-stroke rotation or under-rotation, a limiting device is arranged between the support leg and the mounting shaft (or seat board).

The limiting device is a limiting block. Specifically, a first limiting block is provided on a side wall of the mounting shaft, and a second limiting block is provided on the support leg. When the support leg is unfolded to a support state, that is, when the support leg is perpendicular to the seat board, the first limiting block is in contact with the second limiting block to realize quick limiting. In this example, the limiting device is mounted at the other end of the mounting shaft, that is, the clutch mechanism is mounted at one end of the mounting shaft, and the limiting device is mounted at the other end of the mounting shaft.

The limiting device may also be other structures. For example, an elastic steel ball can be arranged on a side wall of the mounting shaft (or hinged seat), the elastic steel ball includes a steel ball body and a spring, and a positioning hole is arranged in the hinged seat (or mounting shaft). When the support leg is unfolded to a support state, that is, when the support leg is unfolded to be perpendicular to the seat board, the steel ball is inserted into the positioning hole to realize quick and accurate unfolding of the support leg.

In the gardening stool of the disclosure, the clutch mechanism is redesigned and optimized and is compact in structure, low in manufacturing cost, and stable and reliable in connection; the clutch mechanism includes few components and is convenient and quick in assembly, and the working stability and reliability are improved; a plurality of connecting parts are uniformly distributed in a circumferential direction, the contact area is large, the contact force is balanced, the phenomenon of stress concentration is avoided, the connection strength is high, and quick positioning and axial insertion of the third connecting piece are facilitated to realize quick connection; the clutch mechanism is completely made of metal and thus is high in strength, good in deformation resistance, resistant to corrosion, good in stability, and long in service life; the clutch mechanisms on the two support legs are located on the same side, so that quick unlocking can be realized, and quick folding is facilitated; and by arranging the limiting devices, the support legs can be quickly unfolded, and two connecting pieces can be quickly positioned, thereby improving the unfolding efficiency and accuracy. The gardening stool of the disclosure can be folded or unfolded quickly and is high in strength, long in service life and wide in application scope.

The above examples are only the preferred examples of the disclosure. It should be noted that those skilled in the art can make several improvements and modifications without departing from the technical principles of the disclosure, and these improvements and modifications should also be regarded as within the protection scope of the disclosure.

What is claimed is:

1. A gardening stool, comprising a seat board (2), wherein horizontally arranged mounting shafts (3) are fixed at two ends of the seat board (2), each of the mounting shafts (3) is rotationally hinged with a support leg (1), and for each mounting shaft (3) and the support leg (1) corresponding to the mounting shaft (3), a clutch mechanism is provided between the mounting shaft (3) and the support leg (1); the clutch mechanism comprises a first connecting piece (51), a second connecting piece (52) and a third connecting piece (4) which are arranged coaxially; the first connecting piece (51) is fixed on the mounting shaft (3), and the first connecting piece (51) is provided with a first connecting part; the second connecting piece (52) is fixed on the support leg (1), and the second connecting piece (52) is provided with a second connecting part; the third connecting piece is in slide fit on the mounting shaft (3), and the third connecting piece (4) is provided with a third connecting part; and when the support leg (3) is rotated to a support state, the first connecting part is coaxial with the second connecting part, the third connecting piece slides outward, and the third connecting part can be connected to the first connecting part and the second connecting part at the same time so as to realize the fixing of the support leg.

2. The gardening stool according to claim 1, wherein the first connecting piece and the second connecting piece are non-circular columnar bodies with the same cross section, and the third connecting piece is provided with a sleeve hole having the same shape as the columnar body.

3. The gardening stool according to claim 1, wherein the first connecting piece and the second connecting piece have the same structure, comprising a connecting piece body, and first grooves or first protrusions are uniformly distributed on side walls of the connecting piece body in a circumferential direction; and an end of the third connecting piece is provided with a sleeve hole, an open end of the sleeve hole faces the first connecting piece and the second connecting piece, and second protrusions which can be inserted into the first grooves or second grooves in which the first protrusions can be clamped are uniformly distributed on an inner wall of the sleeve hole in a circumferential direction.

4. The gardening stool according to claim 1, wherein a chamfer is provided at an end of the first connecting part and/or an end of the third connecting part.

5. The gardening stool according to claim 3, wherein the third connecting piece comprises a sleeve body, two ends of the sleeve body are provided with a guide hole (40) and a sleeve hole (41) which are coaxial and are communicated with each other, and a depth of the sleeve hole is greater than or equal to a sum of the thicknesses of the first connecting piece and the second connecting piece.

6. The gardening stool according to claim 1, wherein the support leg (1) comprises a support leg body, two hinged seats (11) are provided at upper ends of the support leg body, the two hinged seats (11) are arranged in parallel, each of the hinged seats (11) is provided with a hinged hole for allowing a mounting seat to pass through, and the second connecting piece (52) is fixed on an inner wall of the hinged seat (11) and is coaxial with the hinged hole.

7. The gardening stool according to claim 5, wherein the depth of the guide hole (40) is greater than or equal to ½ of the height of the sleeve body.

8. The gardening stool according to claim 1, wherein the thickness of the first connecting piece or the second connecting piece is greater than or equal to 2 mm and less than or equal to 8 mm.

9. The gardening stool according to claim 1, further comprising limiting devices, wherein each of the limiting devices comprises a first limiting block fixed on the support leg and a second limiting block fixed on the mounting shaft, and when the support leg is unfolded to a support state, the first limiting block is in contact with the second limiting block.

10. The gardening stool according to claim 1, wherein the clutch mechanisms on the two support legs are located on the same side.

* * * * *